US006616482B2

(12) United States Patent
De La Cruz et al.

(10) Patent No.: US 6,616,482 B2
(45) Date of Patent: Sep. 9, 2003

(54) CONNECTOR PROVIDED WITH CONTACTS MOUNTED IN AN ADAPTED INSULATOR

(75) Inventors: Jose De La Cruz, Parigne l'eveque (FR); Jean-Claude Guyon, Yvre-l'eveque (FR); Alain Philippe, Champagne (FR); Jean-Yves Lecoq, Mulsanne (FR)

(73) Assignee: FCI, Courbevoie (FR)

( * ) Notice: Subject to any disclaimer, the term of this patent is extended or adjusted under 35 U.S.C. 154(b) by 0 days.

(21) Appl. No.: 09/964,993

(22) Filed: Sep. 26, 2001

(65) Prior Publication Data

US 2002/0068483 A1 Jun. 6, 2002

(30) Foreign Application Priority Data

Sep. 27, 2000 (FR) ..... 00/12319

(51) Int. Cl.[7] ..... H01R 9/03
(52) U.S. Cl. ..... 439/610; 439/941; 439/934
(58) Field of Search ..... 439/610, 941, 439/418, 934, 460, 608; 174/32, 34, 27, 138 E, 146

(56) References Cited

U.S. PATENT DOCUMENTS

| | | | | |
|---|---|---|---|---|
| 3,986,765 A | | 10/1976 | Shaffer et al. | |
| 4,493,525 A | | 1/1985 | Hall et al. | |
| 5,961,351 A | * | 10/1999 | Wu | 439/610 |
| 6,280,232 B1 | * | 8/2001 | Beecher et al. | 439/610 |
| 6,290,532 B1 | * | 9/2001 | Vermeersch et al. | 439/941 |

FOREIGN PATENT DOCUMENTS

| | | |
|---|---|---|
| EP | 0755100 A2 | 1/1997 |
| FR | 2762453 | 10/1998 |

* cited by examiner

*Primary Examiner*—Tho D. Ta
(74) *Attorney, Agent, or Firm*—Perman & Green, LLP

(57) ABSTRACT

A connector (1) includes a body (7) for connecting wires (4) of a quadriaxially twisted cable (2) with contacts (11) of said connector. The connector includes insulating parts (14, 24, 34) for receiving the twisted cable, the untwisted wires and also to allow connecting the untwisted wires with the contacts. The insulating parts include channels arranged such that the characteristic impedance of the cable in the region of the untwisted wires is held at the same level as the characteristic impedance of the twisted wires.

8 Claims, 2 Drawing Sheets

CONNECTOR PROVIDED WITH CONTACTS MOUNTED IN AN ADAPTED INSULATOR

BACKGROUND OF THE INVENTION

The present invention relates to connectors and, more particularly, to connectors for high frequency cables.

BRIEF SUMMARY OF THE INVENTION

The invention has for object a connector provided with contacts mounted in an adapted insulator. It is used more particularly in the field of connectors mounted at an end of a cable, to join wires of such cable with contacts contained in the connector, thus allowing a connection with another electronic device, for example, another cable. The invention is applied particularly in the field of connectors for Full Duplex Ethernet cables, this type of cable being used to convey very high frequencies, including the cases in the field of onboard networks, for example in avionics applications. These cables and connectors are designed to be able to convey signals at a frequency of up to about 1 GHz.

The cables are characterized by their characteristic impedance. This characteristic impedance is determined mainly according to the geometry of the cable, as well as according to the materials used to form this cable. The term of geometry covers more particularly the disposition of the wires of the cable inside an insulator of such cable, as well as the respective distances between each of the wires of the cable, and the respective distances between each wire of the cable and a plait of the cable. Namely, the cables generally include a plait surrounding the insulator at an outside periphery, the insulator holding the wires. Besides, the wires of the cable are twisted inside the insulator. This twisted disposition plays also a role in the definition of the characteristic impedance.

In the state of the art, the document FR-A 2 762 453 is known, which teaches a structure of a high frequency electrical connector. This connector includes an insulating body mounted at an outside periphery of the plait of a cable, whereas the connector includes electrical contacts intended to be connected at a first end of the cable wires. However, the cable generally includes several pairs of wires. Therefore, the connector includes several corresponding pairs of contacts. A pair of contacts is arranged in an individual insulating module, so that each insulating module is insulated by means of an individual electromagnetic screen. In such a connector, the wires are untwisted in the region of an intermediate zone in order to be oriented and connected with their respective pair of contacts. In such zone, the characteristic impedance of the cable is modified, merely due to the fact that the cables are untwisted and the relative positions of the wires remain unsecured.

The problem solved by the known documents in the state of the art is to insure a continuity of the screens against electromagnetic interferences likely to be created between the pairs of contacts when these are untwisted and arranged in the connector. In view of this, mainly screening cross-pieces are known which are arranged between each of the insulating modules to separate them from each other. Means to secure the continuity of the characteristic impedance of the cable in the region of the connector are nowhere teached in the state of the art.

The connectors of the state of the art lead to a problem. Namely, the installation of the cable in the connector results in a change of the characteristic impedance of the cable in the region of this connector. The characteristic impedance of the cable being not uniform, a loss in adaptation of the cable is observed.

Particularly when high frequency currents are conveyed by the cable, some losses in the signal are observed, by reflection, because of the variations of the characteristic impedance. In order to be able to guarantee a uniform characteristic impedance along the whole length of the cable, even in the region of the splices, it would be necessary to keep the cable twisted along the whole length thereof. However, this cannot be achieved in the region of the connectors.

An object of the invention is to solve the above problem by providing a connector wherein the cable, while being untwisted, can insure the continuity and the uniformity of the characteristic impedance between the twisted and the untwisted regions of the cable. In this view, the invention provides the use of a quadraxially twisted cable (so-called "quad" by the persons skilled in the art) that allows insuring a uniform immunity level, the received perturbations being identical on the different pairs, and because of the symmetrical configuration of the pairs in this type of cable, a differential effect is generated that involves the efficient subtraction of said perturbations. In order to maintain this characteristic, an insulator is provided in the connector, such insulator being able to receive the untwisted wires of the cable and so to insure a characteristic impedance of the untwisted cable, which is very close to the characteristic impedance of the still twisted cable. The insulator of the connector is designed so that the geometry thereof provides channels in which the wires of the cable can be arranged, as well as contacts intended to be connected at the ends of the wires of the cable. Indeed, the geometry of the disposition, such as for example of the relative spacing of the channels, is calculated so that the characteristic impedance of the cable in the region of this insulator is nearly identical to the characteristic impedance before the mounting thereof in the connector. Thus, the invention allows the cable it to keep its characteristics and in particular a characteristic impedance generally uniform, even in the region of the connector.

An object of the invention is a connector including a body to be mounted on a quadriaxially twisted cable, and including at least four contacts and an insulator, such insulator receiving at a first end wires of the cable, and at a second end contact sockets, wherein each wire is able to be connected respectively with one respective socket, characterized in that said insulator includes the channels in which the untwisted wires and the sockets extend, and in that a geometry of the symmetrical disposition of the channels in the insulator is determined according to a characteristic impedance of the cable.

BRIEF DESCRIPTION OF THE DRAWINGS

The invention will be better understood when reading the following description in reference to the appended figures. Such figures are merely illustrative of the invention and are not intended to limit the invention. Among the figures.

DETAILED DESCRIPTION OF THE INVENTION

Figure 1:
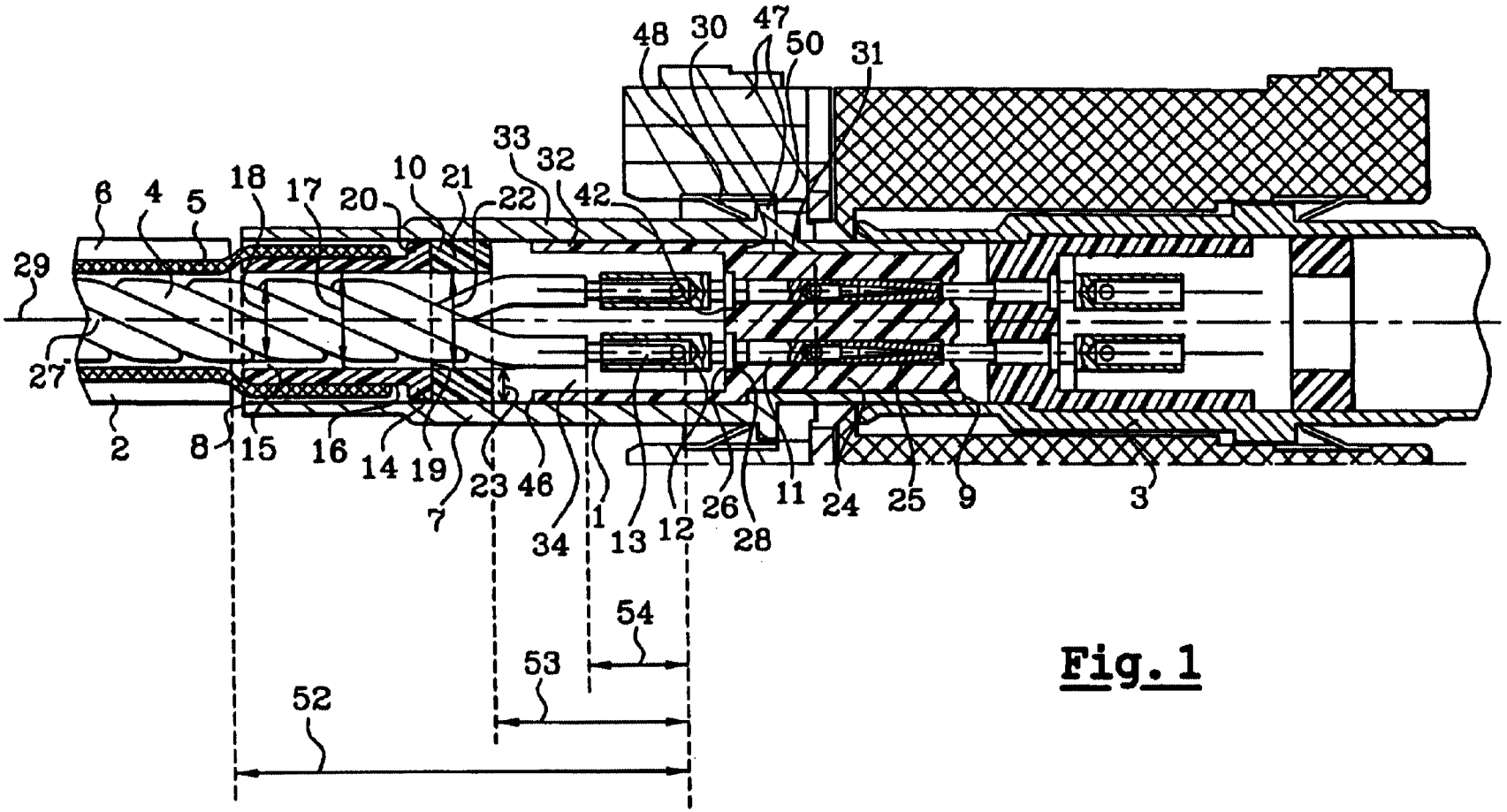
FIG. 1 shows a sectional view of a set of connectors connected together according to the invention.

FIG. 1 shows a connector 1 according to the invention. The connector 1 is mounted on a "quad" cable 2. Further, the connector 1 is connected to a complementary connector 3, wherein such complementary connector 3 can have a structure which is similar to that of connector 1. In this case, the connector 3 is also realized according to the invention.

The cable 2 is intended to be able to convey currents at a frequency of the order of 1 GHz. In this view, the cable 2 has preferably a characteristic impedance of the order of 100 Ohms plus or minus 20%. The cable 2 includes four wires 4. The wires 4 are preferably twisted together. The cable 2 includes for example two pairs of wires 4. It is preferably of the Full Duplex Ethernet type, including two pairs of wires, or again four individual wires. These wires 4 are mounted in a plait 5 functioning to insure an electromagnetic screening for the wires 4. The plait 5 is for example metallic. Moreover, the cable 2 comprises a sheath, preferably an insulating sheath, which surrounds the plait 5.

The connector 1 includes a body 7, this body 7 having preferably an extended and tubular shape, opened at a first end 8 in order for receiving the cable 2, and opened at a second end 9 for receiving the complementary connector 3. Such body 7 is preferably metallic; it insures the continuity between the screen 7 and the plait 5. In this view, the connector 1 has means to resume the screening in the region of the first end 8.

The connector 1 further includes an insulator 10 arranged inside the body 7 between ends 8 and 9. Such insulator 10 surrounds mainly the wires 4 of the cable 2, and keeps contacts 11 of the connector 1 otherwise. Each of such contacts 11 includes a socket 12, each socket being connected with a core 13 of a wire 4. Moreover, contacts 11 can include a male or female end. In the example presented in FIG. 1, the connector 1 includes contacts 11 with a female end.

In a preferred example, the insulator 10 includes preferably three parts. A first part forms rear insulator 14. This rear insulator 14 has a cylindrical shape able to receive the still twisted wires 4 in a central cavity 15. Preferably, the plait 5 is arranged at an outside periphery 16 of this lower insulator 14 having the shape of socket. An inside diameter 17 of the cavity 15 of the socket 14 is of the order of an outside diameter 18 of the twisted wires 4. Namely, some wires 4 are twisted so that they form a cylindrical wire crossing such cavity 15. To install this connector 1 on the cable 2, a portion of the sheath 6 is first exposed in order that a portion of the plait 5 and the twisted wires 4 of this sheath 6 can extend beyond the rear insulator 14.

The plait 5 is also exposed of such way as to let pass a portion of the wires 4 beyond the plaited region 5. Moreover, the plait 5 is arranged at an outside periphery of the socket 14. The plait 5 is preferably comprised of a mesh which is able to be slightly loosened in this region in order to increase the inner diameter thereof, such inner diameter being initially similar to that of the strand formed by the wires 4.

The rear insulator 14 has such a length that the twisted wires 4 extend beyond the socket 14 in the region of a front opening 19. The socket 14 further includes a flange 20 intended to cooperate for example with holding means (not represented) arranged inside the body 7. In the region of the front opening 19, the wires 4 begin to be untwisted. In this view, the insulator 10 can further comprise an intermediate piece 21 coupled with the opening 19, as this intermediate piece 21 has an inside diameter 22 which is preferably identical to the inside diameter 17. Moreover, a thickness 23 of the periphery surrounding the untwisted wires 4 is larger in order to maintain the same characteristic impedance of the cable 2.

This intermediate piece 21 is mounted around the wires 4 from the exposed end of the wires 4. In this preferred example, the intermediate piece 21 is supported directly against the opening 19 of the socket 14.

The insulator 10 further includes a front part 24 intended to receive contacts 11. In this view, it comprises the channels 25 in which the contacts 11 are extended and presented. In the case where the contact 11 is a female socket, the front insulator 24 is provided so that the channel 25 protects the female end of the contact 11 along the whole length thereof. In the case where the contact 11 is a male contact, the front insulator 24 is provided so that the channels 25 only surround a front portion of the contact, this front portion being not intended to be connected with a complementary contact.

The contacts 11 comprise generally a flange 26 in order to be blocked in translation along an longitudinal axis 27 of the contact. Such flange 26 cooperates with a step 28 of the front insulator 24 in order to prevent the translation thereof in a direction along an axis 29 of the connector, extending parallel to the axis 27, of the contact 11 in the front insulator 24. In the same way, the translation of the insulator 24 inside the body 7 along the same axis 29 is also prevented by the cooperation between a flange 30 of the outside periphery of the front insulator 24 and an inner step 31 of the body 7.

The front insulator 24 includes a rear socket 32 adjacent to an inner surface 33 extending from the flange 30 inside body 7.

Figure 2A:
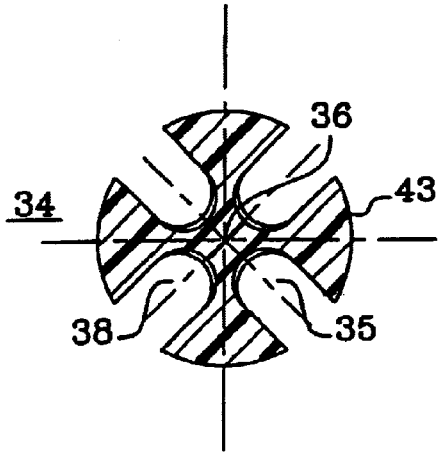
FIG. 2*a* shows a cross-sectional view of a first end of an insulator of the connector according to the invention.
Figure 2B:
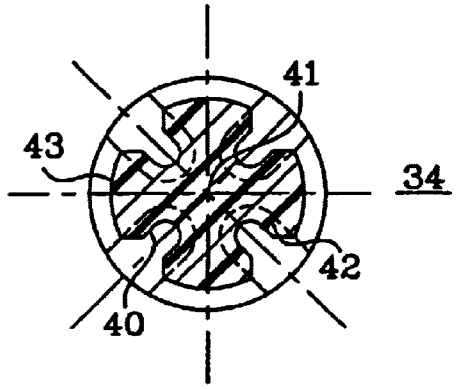
FIG. 2*b* shows a cross-sectional view of a second end of an insulator of the connector according to the invention.

The insulator 10 also includes an intermediate insulator 34. The intermediate insulator 34 is arranged between on the one hand the rear insulator 20, possibly the intermediate piece 21, and on the other hand the front insulator 24. FIGS. 2*a* and 2*b* present a cross-sectional view of this intermediate insulator 34. The connection between the wires 4 of the cable 2 and the socket 12 of the contact 11 is established in the region of this intermediate insulator 34. Namely, the intermediate insulator 34 include channels 35 intended for receiving each at least one wire 4, and at least one socket 12 of contact 1 that are to be connected with each other.

In a preferred example, the intermediate insulator 34 has a cylindrical shape a cross-section of which has the shape of a circle. This circle has a center 36. The arrangement of the channels 35 in this intermediate insulator 34 is such that, in the region of an end 37, the cross-section of which corresponds to FIG. 2*a*, the channels 35 are held at equal distances across the center 36. In this example, the intermediate insulator 34 includes four intermediate channels, such as 35. In this preferred example, the four channels 35 are arranged so that the respective center of each of the channels is arranged at one corner of a square 38 such that the center of this square 38 forms the center 36. A distance between two juxtaposed corners of the square is for example more or less the order of 2 cm plus or minus 0,04 cm. Moreover, a distance between a corner of this square 38 and the center 36 is of the order of 1,40 cm. The channels 35 are therefore relatively very close to the center 36.

The arrangement of the channels 35 in the region of the end 37 allows receiving mainly the wires 4, which are still in a twisted condition. An end 39, the cross-section of which corresponds to FIG. 2*b*, is arranged on a face lying opposite the end 37 of the intermediate insulator 34. In the region of this end 39, the sockets 12 are presented to receive the cores 13. The end 39 then includes four openings 40 clearing on the four channels 35. These openings 40 are also arranged at equal distances across the center 41 of the face 39, this center 41 being aligned with the center 36 along the axis 29. Further, in the region of this end 39, each channel 35 includes a step 42 allowing the retention of the sockets 12 in this portion of the intermediate insulator 34.

Moreover, in a preferred embodiment of this intermediate insulator 34, in order to facilitate the insertion of the socket 12 in the channels 35, on the one hand, and on the other hand a sliding of the wires 4 so that the cores 13 fit in the sockets 12, the channels 35 are cut as from an outside periphery 43 of the intermediate insulator 34. It can thus be seen that the cross-section of this intermediate insulator 34 as a shape of a "clover".

Figure 3:
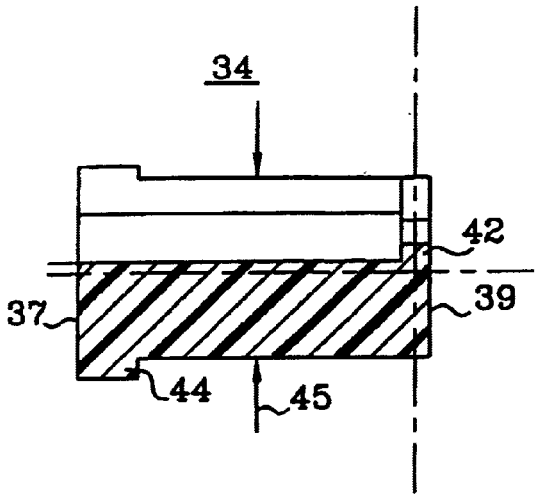
FIG. 3 shows a longitudinal sectional view of an insulator of the connector according to the invention.

Further, in the region of the end 37, the intermediate insulator 34 include a step 44, FIG. 3, thus increasing a mean diameter 45 of the intermediate insulator 34. This step 44 allows a cooperation with an end 46 of the rear socket 32 formed by the front insulator 24. This step 44 prevents particularly the translation of the front insulator along an opposing direction of the axis 29.

Moreover, the body 7 includes a flange 47 for cooperating with resilient locks 48, these locks 48 being presented inside an body 49 intended to receive the connector 1. Besides, the flange 47 abuts against an edge 50 provided in this body 49 in order to block the connector 1 in the body 49.

Figure 4:
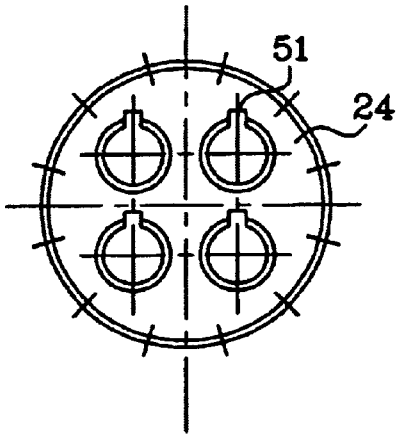
FIG. 4 shows a cross-sectional view of a front part of the insulator according to the invention.

FIG. 4 shows a cross-section of the front insulator 24, wherein each of the channels 25 provided for having male or female contact ends on the contacts 11 includes a groove 51, such groove 51 being able to cooperate with a key or an resilient blade of a contact in order to insure an unique orientation of contact inside the channel 25. Therefore, the method of connection of the connector 1 with a complementary connector is unique, whereas the key of each of the contacts of the complementary connector must absolutely be able to be inserted correctly in the associated grooves 51. The groove 51 is associated locally with an increase of the size of the opening. Thus, when the front insulator 24 has to be used for receiving contacts 11 having no such pin, the presence of the groove 51 doesn't prevent the insertion of these contacts having no pin.

This solution for the positioning of the contacts by means of a groove in the channels of the front insulator just ahead of the retention clip has the numerous following advantages. Mistakes in the installation are avoided, the clip being able to hold the contacts in the cell only if the key has entered in the groove completely. A mere traction on the cable allows controlling and insuring a correct position of the contact. Should the connector be closed with an ill mounted contact, the contact is moved back without being damaged. It is also possible to mount coaxial, "coax", or triaxial, "triax" cables having no positioning device or indexing in the connector.

For installing the connector 1, the cable 2 to be inserted in the body 7 of the connector 1 is first exposed. A differential exposing of the cable is preferably effected. The sheath 5 is exposed along a first length 52. The wires 4 are then exposed along a second length 53. And finally, the wires 4 are exposed such as to expose the cores 13 along a third length 54. The length 54 is shorter than the length 53, which in turn is shorter than the length 52.

Then, the rear insulator 14 is, starting from the exposed end of the cable, mounted by sliding. The rear insulator 14 is arranged so that the sheath 6 is not inserted, and does not surround the rear insulator 14. On the contrary, the plait 5 exposed along a length between the length 52 and the length 53, is arranged at an outside periphery of the rear insulator 14.

The intermediate piece 21 can be mounted in the same way, starting from the exposed end of the cable until it abuts against the rear insulator 14. The contacts 11 are inserted starting from the end 39 of the central insulator 34. The sockets 12 are inserted in the channels 35 from the outside periphery of this central insulator 34. The wires 4 are then moved away from each other in order to arrange each wires in a respective channel 35, such that the core 13 of each wire 4 is inserted in a socket 12.

The front insulator 24 is then mounted on the central insulator 34, so that the male and female ends of the contacts 11 are slided into the channels 25. There is a possible cooperation between the keys of the contacts and the grooves 51 to guarantee a correct positioning of the front insulator 24. The front insulator 24 is driven so that the socket 32 surrounds the central insulator 34, and until the two insulators abut against each other.

The assembly formed of the wires 2 and the insulator 10 thus mounted is then inserted in the body 7 until the flange 30 of the front insulator 24 abuts against the inner step 31. In turn, the connector 1 is then able to be arranged in the insulating body 49 and held by a set of resilient locks.

What is claimed is:

1. A connector including a body mounted on a quadriaxially twisted cable and including at least four contacts and an insulator, said insulator receiving at a first end wires of the cable, and receiving sockets of said contacts at a second end of the insulator, each wire is able to be connected with a respective socket, characterized in that said insulator includes channels in which the wires and the sockets extend, and in that a geometry of symmetrical disposition of the channels in the insulator is determined according to a characteristic impedance of the cable.

2. A connector according to claim 1, characterized in that the channels are equidistant two by two, and close to each other.

3. A connector according to claim 1, characterized in that the channels are formed in a central part (34) of the insulator, said central part having a tubular shape, the channels being hollowed starting from a peripheral surface (43) of said central part.

4. A connector according to claim 1, characterized in that a channel includes a positioning groove (51) for cooperating with a key of a contact in order to guarantee an unique orientation of the contact in the insulator.

5. A connector according to claim 1, characterized in that one contact includes a flange (26) holding the contact on the insulator.

6. A connector according to claim 1, characterized in that the insulator includes three parts: a rear part (14) around the wires of the cable, a central part (34) in the region of which the wires of the cable are linked to the contacts, and a front part (24) in a mating region of the contacts.

7. A connector according to claim 6, characterized in that each of the front, central and rear parts are symmetrical in relation to the axis of the connector (29).

8. A connector including a body to be mounted on a quadriaxially twisted cable and including at least four contacts and an insulator, said insulator receiving at a first end wires of the cable, and receiving sockets of said contacts at a second end of the insulator, each wire is able to be connected with a respective socket, characterized in that said insulator includes channels in which the wires and the sockets extend, and in that a geometry of symmetrical disposition of the channels in the insulator is determined according to a characteristic impedance of the cable, and characterized in that the insulator includes three parts, a rear part around the wires of the cable, a central part in a region of which the wires of the cable are linked to the contacts, and a front part in a mating region of the contacts, and characterized in that the rear part includes a socket and an optional intermediate piece, such that an inner diameter of the socket and the intermediate piece are substantially identical to the diameter of the twisted wires.

* * * * *